US010550534B1

(12) United States Patent
Neelamani et al.

(10) Patent No.: US 10,550,534 B1
(45) Date of Patent: Feb. 4, 2020

(54) METHOD FOR DAMPING OCEAN WAVES IN A COASTAL AREA

(71) Applicant: KUWAIT INSTITUTE FOR SCIENTIFIC RESEARCH, Safat (KW)

(72) Inventors: Subramaniam Neelamani, Riggae (KW); Noor Al-Anjari, Kuwait (KW)

(73) Assignee: Kuwait Institute for Scientific Research, Safat (KW)

( * ) Notice: Subject to any disclaimer, the term of this patent is extended or adjusted under 35 U.S.C. 154(b) by 0 days.

(21) Appl. No.: 16/528,594

(22) Filed: Jul. 31, 2019

(51) Int. Cl.
*E02B 3/04* (2006.01)
*E02B 3/06* (2006.01)

(52) U.S. Cl.
CPC ..... *E02B 3/06* (2013.01)

(58) Field of Classification Search
CPC ..... E02B 3/06; E02B 3/062
See application file for complete search history.

(56) References Cited

U.S. PATENT DOCUMENTS 1,353,001 A 9/1920 Uriarte
2,014,116 A * 9/1935 Powers ..... E02B 3/06 405/23
2,474,786 A * 6/1949 Humphrey ..... E02B 3/06 405/30
2,658,350 A 11/1953 Magill
3,011,316 A 12/1961 Wilson
3,118,282 A * 1/1964 Jarlan ..... E02B 3/06 405/31
3,280,569 A * 10/1966 Wosenitz ..... E02B 3/06 405/34
3,387,458 A 6/1968 Jarlan
3,487,645 A 1/1970 Frankel
3,846,988 A * 11/1974 Lamy ..... E02B 3/06 405/31
3,878,684 A * 4/1975 Lamy ..... E02B 3/06 405/31
4,154,548 A 5/1979 Ijima
4,367,978 A 1/1983 Schaaf et al.
(Continued)

OTHER PUBLICATIONS

Premasiri, "Experimental Study of Wave Interactions with Slotted Barriers," Thesis, Jan. 1997.

*Primary Examiner* — Benjamin F Fiorello
*Assistant Examiner* — Edwin J Toledo-Duran
(74) *Attorney, Agent, or Firm* — Richard C. Litman; Nath, Goldberg & Meyer

(57) ABSTRACT

The method for damping ocean waves in a coastal area uses a barrier having a plurality of vertical walls positioned parallel to one another, each wall defining a plurality of horizontally extending slots. The dimensions of the slots, or overall porosity of the wall, and the number of walls positioned in parallel may be varied to provide different levels of damping. Accordingly, a desired amount of damping may be provided through varying the porosity of the walls and the number of walls. The method defines a transmission coefficient equal to the wave height of waves transmitted from the barrier divided by the wave height of waves incident on the barrier, and collects experimental data normalized with the significant wave height and the wavelength at the peak period for the depth of water to select the combination of wall number and porosity to produce the desired damping.

9 Claims, 7 Drawing Sheets

(56) References Cited

U.S. PATENT DOCUMENTS 4,711,598 A 12/1987 Schaaf et al.
4,764,052 A * 8/1988 Jarlan ..... E02B 3/06 405/31
4,776,725 A * 10/1988 Brade ..... E02B 3/06 405/262
4,836,709 A 6/1989 Ploeg et al.
4,954,013 A * 9/1990 Lamberton ..... E02B 3/06 405/25
6,454,491 B1 * 9/2002 Wayne ..... E02B 3/06 405/32
7,146,919 B1 * 12/2006 Ehrenreich ..... E02B 3/06 114/67 R
7,524,139 B2 * 4/2009 Bishop ..... E02B 3/06 405/21
9,340,940 B2 * 5/2016 Neelamani ..... E02B 3/062
9,447,554 B1 * 9/2016 Neelamani ..... E02B 3/062
9,624,636 B2 * 4/2017 Andrus ..... E02B 3/06
2002/0168228 A1 * 11/2002 Benedict ..... E02B 3/04 405/21
2006/0216115 A1 * 9/2006 Cho ..... E02B 3/062 405/30
2008/0022915 A1 * 1/2008 Budd ..... E02B 3/062 114/355
2008/0279631 A1 * 11/2008 Bishop ..... E02B 3/06 405/21
2009/0154996 A1 6/2009 Liner
2009/0238645 A1 * 9/2009 Aristaghes ..... E02B 3/06 405/21
2014/0270962 A1 9/2014 Andrus et al.
2015/0152615 A1 * 6/2015 Bishop ..... B63G 9/04 405/23
2016/0053454 A1 * 2/2016 Neelamani ..... E02B 3/04 405/26
2016/0289907 A1 * 10/2016 DeCew ..... B66D 1/60

* cited by examiner

METHOD FOR DAMPING OCEAN WAVES IN A COASTAL AREA

BACKGROUND

1. Field

The disclosure of the present patent application relates to breakwater systems, and particularly to a method for damping ocean waves in a coastal area to an extent required for different applications using a plurality of parallel slotted vertical barriers to dissipate water wave energy.

2. Description of the Related Art

An ocean wave contains energy and is the main cause for beach erosion. Around the world, billions of dollars are spent every year for reducing coastal erosion. There are many solutions used around the world, such as seawalls, groin fields, and offshore breakwaters. Each solution has its own merits and demerits. A seawall helps to protect the coastal property from erosion, but accelerates more loss of beach sand. An offshore breakwater using rubble mounds, as seen in FIG. 1, helps to protect a beach from erosion when waves are predominantly perpendicular to the beach, but they make the beach curvilinear and introduce a rip current channel in between the gaps in the offshore breakwaters. Groin fields work well if the incident waves are inclined to the shore line, but also result in more erosion at downstream beach areas. These solutions are also expensive, and their construction causes environmental damage, such as eradicating the benthic life and deteriorating water quality during construction. Additionally, they are heavy, and their removal, if warranted, is expensive, and their construction also takes significant span of time.

Wave conditions are site specific. The highest wave in 100 years at one location (e.g., the Arabian Gulf) may be 3.0 m, whereas it can be 8.0 m to 10.0 m for the Bay of Bengal or the Atlantic or Pacific Ocean. The transmission coefficient (which is defined as the ratio of transmitted wave height to incident wave height) allowed for reducing beach erosion may be 0.1 at a place with fine sand on the beach, and it can be 0.3 in another place with very course sand and pebbles. Similarly, for an open sea swimming pool, it is necessary to provide higher wave damping for a children's pool than a pool used by adults. In many cases, it may be necessary to dampen a wave to a certain level so that the transmitted wave induced force acting on an existing marine structure, such as open sea aqua-cultural cages or open sea loading/unloading facilities, will be reduced considerably to increase the life span of such structures. Additionally, for many open sea construction activities in the coastal area, a certain order of wave damping is required for successful and uninterrupted construction activities throughout the year. It is also required to allow some small action of waves always on the beach so that the beach quality is maintained throughout the year by the work of nature Thus, a method for damping ocean waves in a coastal area solving the aforementioned problems is desired.

SUMMARY

The method for damping ocean waves in a coastal area uses a barrier having a plurality of vertical walls positioned parallel to each other, each of the walls defining a plurality of horizontally extending slots. The dimensions of the slots, or overall porosity of the wall, can be varied to provide different levels of damping. Similarly, the number of walls positioned parallel to each other may also be varied to provide different levels of damping. Accordingly, a desired amount of damping may be provided through varying the porosity of the walls and the number of walls.

Selecting a proper barrier may include generating charts or referring to charts that provide wave transmission coefficients for barriers having different numbers of walls and different porosities. The selection process may also consider volume of the different barriers (including comparison to a conventional rubble mound breakwater barrier), an amount of horizontal wave force enacted on the different barriers, and an amount of wave induced moment enacted on the different barriers.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The method for damping ocean waves in a coastal area uses a barrier having a plurality of vertical walls positioned parallel to one another, each wall defining a plurality of horizontally extending slots. The dimensions of the slots, or overall porosity of the wall, can be varied to provide different levels of damping. Similarly, the number of walls positioned in parallel and the positioning of the horizontal slots in neighboring walls at different heights in zig-zag manner may also be varied to provide different levels of damping. Accordingly, a desired amount of damping may be provided through varying the porosity of the walls and the number of walls. U.S. Pat. No. 9,447,554, issued to Neelamani (one of the present inventors) et al. on Sep. 20, 2016, which is hereby incorporated by reference in its entirety, discloses a similar method and structure, but the structure in the '554 patent included a water-impregnable rear barrier behind the slotted vertical walls so that there is essentially no wave transmitted behind the barrier, and the method was directed towards the problem of waves reflected back from the barrier, being directed towards the interior portions of marinas, ports, and harbors, rather than protection from soil erosion and other problems arising from ocean waves impacting coastal areas.

Figure 1:
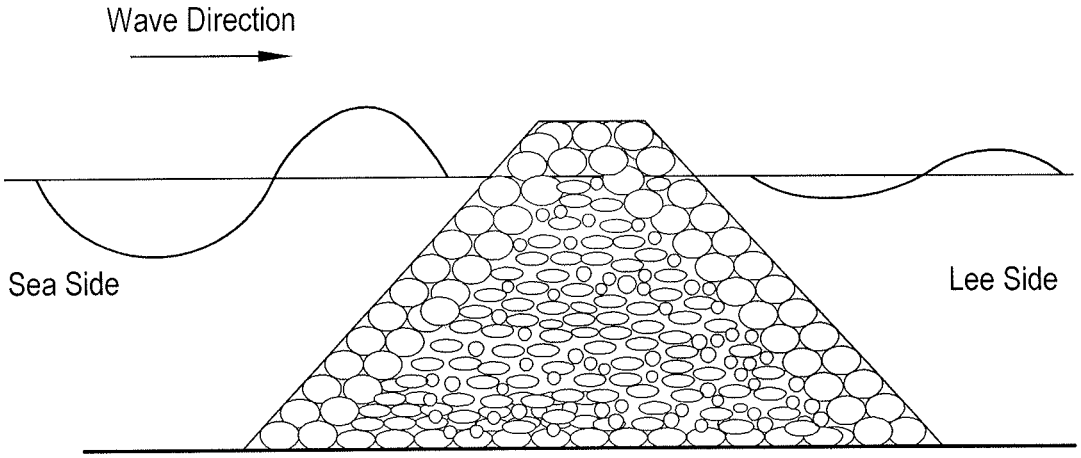
PRIOR ART FIG. 1
FIG. 1 is a diagram showing a prior art rubble mound breakwater, along with an incident wave and a wave transmitted through or from the breakwater mound.
Figure 2:
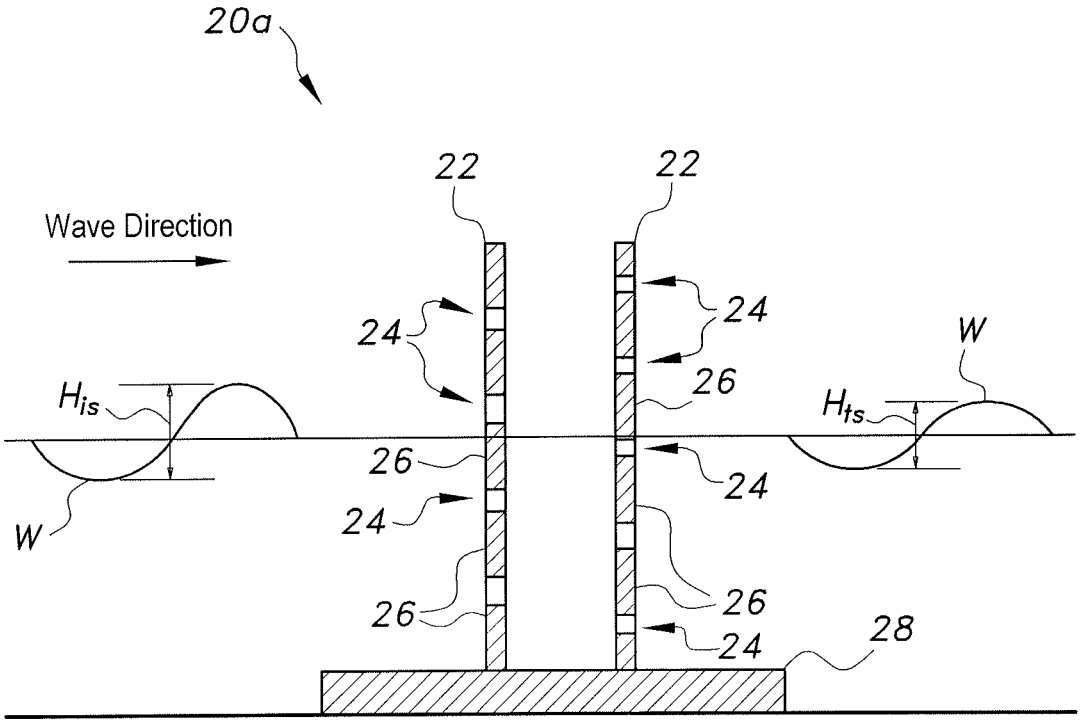
FIG. 2 is a schematic diagram of an exemplary breakwater barrier having two slotted vertical walls that may be used in a method for damping ocean waves in a coastal area, shown from the side and in section.

The method for damping ocean waves in a coastal area may include use of a barrier 10 having a plurality of slotted vertical walls forming a barrier 20*a*, as shown in FIG. 2. The barrier 20*a* may include one or more vertical slotted breakwater walls 22. As will be described in detail below, the number of walls 22 and the porosity of the walls 22 can be selected based on the desired amount of wave damping, as well as the amount of material to be saved versus a conventional, sloped rubble mound breakwater (shown in FIG. 1). Thus, it should be understood that the barrier 20*a* of FIG. 2, formed from two vertical walls 22, is shown for exemplary purposes only.

In use, a plurality of the vertically extending walls 22 are provided, where each vertically extending wall 22 has a plurality of horizontally extending slots 24 formed therethrough. The areas and/or configurations of the horizontally extending slots 24 can be varied such that each vertically extending wall 22 has a unique degree of porosity. In the example of FIG. 2, each vertically extending wall 22 is shown as a plurality of slats 26 mounted vertically, with horizontally extending slots 24 formed between the slats 26. It should be understood that this configuration is shown for exemplary purposes only, and that each vertically extending wall 22 may have any desired relative dimensions or overall configuration, and the degree of porosity of each wall 22 may be varied. This may be achieved by, for example, varying the number of slats and their respective spacing, or through any other suitable method of manufacture, such as the addition of holes or apertures. It should be understood that the porosity can be defined by the slots 24 between the slats 26. The degree of porosity for each wall 22 can range from about 5% to about 60%.

In order to form the vertically extending barrier 20*a* for damping ocean waves in a coastal area, a user selects one or more vertically extending walls 22. In FIG. 2, the barrier 20*a* is shown formed from a first vertically extending wall 22 and a second vertically extending wall 22 parallel to the first wall 22, with the slots 24 arranged at different heights in zig-zag manner. As shown, the vertically extending walls 22 can extend normal to a horizontal support 28 or floor (e.g., seabed) on which it is positioned. In some embodiments, each wall may be held in place by posts or similar mechanisms inserted into the ground.

Figure 3:
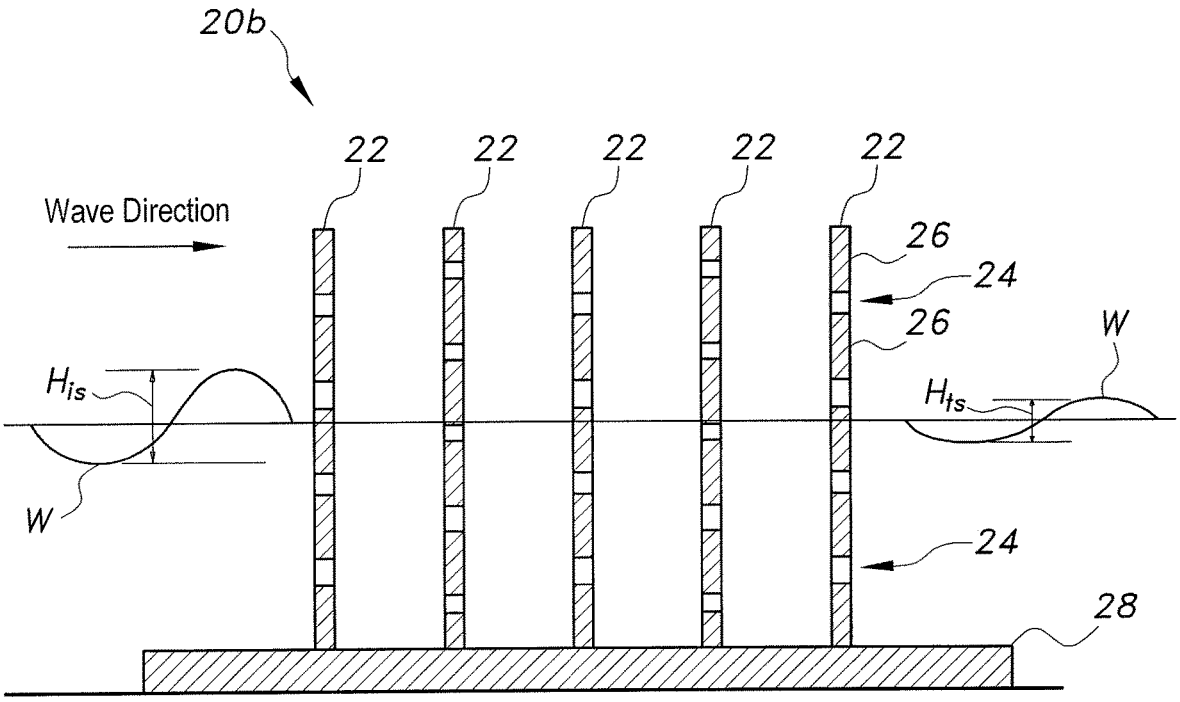
FIG. 3 is a schematic diagram of another exemplary breakwater barrier having five slotted vertical walls that may be used in a method for damping ocean waves in a coastal area, shown from the side and in section.

The slats 26 of each vertically extending wall 22 dampen the energy of the incoming waves W, and the slots 24 between the slats 26 permit the waves W to pass through the walls 22 with reduced wave energy. Compared to a conventional rubble mound breakwater (shown in FIG. 1), the vertically extending walls 22 provide a more gradual dissipation of wave energy. In the example of FIG. 2, two vertically extending walls 22 form the barrier 20*a*. The walls 22 may have specific porosities associated with a desired amount of wave damping. The example of FIG. 2 shows walls 22 with 10% porosity. In the example of FIG. 3, five vertically extending walls 22 form the barrier 20*b*, each wall 22 having the same porosity as the wall of the barrier 20*a*, shown in FIG. 2. As seen by the transmitted wave W, a greater number of walls 22 will provide greater damping when porosity is held constant. The slots 24 of the first wall 22 can be nonaligned or staggered with respect to the slots 24 of an adjacent wall 22, e.g., in a zig-zag configuration.

For example, if the water depth in FIG. 2 is 4.2 m and the incident wave height $H_{is}$ is 0.9 m, the slotted vertical barriers may extend up from the sea floor 7.2 meters. The distance between the walls 22 may be 1.2 m. These dimensions are related for purposes of illustration, and are not intended to be limiting.

The optimal number of vertically extending walls 22 forming the barrier 20*a* or 20*b* and the degrees of porosity associated therewith can be selected based on a desired $K_t$ value (wave transmission coefficient) and/or a minimum number of walls 22 for obtaining desired wave transmission characteristics, which can be equivalent to or better than conventional, sloped rubble mound breakwaters. $K_t$ can be calculated using the following equation:

$$K_t = H_{ts}/H_{is}$$

where $H_{is}$ is the significant incident wave (wave entering barrier) height and $H_{ts}$ is the significant transmitted wave (wave transmitted through or from the barrier) height. The significant wave height is defined as the average top one-third wave heights in a random wave time series acting on the vertical slotted barrier 20*a* or 20*b*. As is known in the art, the $K_t$ value is a function of many parameters, including the number of vertical slotted walls 22, the porosity, the significant wave height, the wavelength corresponding to the peak wave period, and the water depth. The relative water depth is calculated as:

$$d/L_p$$

where d is a depth of water in the coastal area at the structure location and $L_p$ is an incident wavelength of the water wave W in the coastal area corresponding to peak wave period, $T_p$. The relative significant wave height is calculated as:

$$H_{is}/d.$$

Once the number of vertically extending walls 22 and the desired porosity of the walls 22 have been selected, the barrier 20*a* or 20*b* is positioned in the coastal area transverse to the direction of the ocean waves for dissipation of water wave energy (i.e., providing an offshore breakwater in the desired region).

Physical models of the barriers were tested using a wave flume at the Kuwait Institute for Scientific Research, Kuwait. The amount of porosity was varied on the models, which included 5% and 10% to 60% with increments of 10%. Additionally, each porosity variant was tested with 1 to 6 walls 22. Random waves of a wide range of significant wave height and peak periods were tested on each model. The tested relative significant wave heights include 0.071, 0.142, and 0.214. Each relative significant wave height was tested with relative water depths of 0.1 to 0.5 at increments of 0.1.

The transmitted wave time series was measured for the input conditions. Additionally, wave forces and moments were also recorded to provide information pertaining to stability and chance of overturning of the slotted wave barrier structure. Models of conventional, rubble mound breakwaters were also tested. The conventional, rubble mound breakwaters were tested at three heights: submerged crest, crest and still water at same level, and emerged crest level. A crest of the submerged rubble mound was set at approximately 85% of the water level, a crest of the rubble was set at the water level, and a crest of the emerged mound was approximately 115% the water level. Finally, a single wall with 0% porosity was tested.

Table 1 below lists the different barrier configurations tested and their volume in relation to the conventional rubble breakwaters. In column 3, n indicates the number of walls 22 22 and P indicates the porosity percentage provided by the slots 24. The rightmost column indicates a percentage of material volume used for the slotted wall (V1) versus an emerged, conventional rubble breakwater (V2).

TABLE 1

Volume savings for slotted wall barrier

| Configuration Number | Model Description | Symbol (n, P) | (V1/V2) % |
|---|---|---|---|
| 1 | 1 wall with 10% porosity | (1,10) | 0.84 |
| 2 | 1 wall with 20% porosity | (1,20) | 0.75 |
| 3 | 1 wall with 30% porosity | (1,30) | 0.66 |
| 4 | 1 wall with 40% porosity | (1,40) | 0.56 |
| 5 | 1 wall with 50% porosity | (1,50) | 0.47 |
| 6 | 1 wall with 60% porosity | (1,60) | 0.38 |
| 7 | 2 walls with 10% porosity | (2,10) | 1.69 |
| 8 | 2 walls with 20% porosity | (2,20) | 1.50 |
| 9 | 2 walls with 30% porosity | (2,30) | 1.31 |
| 10 | 2 walls with 40% porosity | (2,40) | 1.13 |
| 11 | 2 walls with 50% porosity | (2,50) | 0.94 |
| 12 | 2 walls with 60% porosity | (2,60) | 0.75 |
| 13 | 3 walls with 10% porosity | (3,10) | 2.53 |
| 14 | 3 walls with 20% porosity | (3,20) | 2.25 |
| 15 | 3 walls with 30% porosity | (3,30) | 1.97 |
| 16 | 3 walls with 40% porosity | (3,40) | 1.69 |
| 17 | 3 walls with 50% porosity | (3,50) | 1.41 |
| 18 | 3 walls with 60% porosity | (3,60) | 1.13 |
| 19 | 4 walls with 10% porosity | (4,10) | 3.38 |
| 20 | 4 walls with 20% porosity | (4,20) | 3.00 |
| 21 | 4 walls with 30% porosity | (4,30) | 2.63 |
| 22 | 4 walls with 40% porosity | (4,40) | 2.25 |
| 23 | 4 walls with 50% porosity | (4,50) | 1.88 |
| 24 | 4 walls with 60% porosity | (4,60) | 1.50 |
| 25 | 5 walls with 10% porosity | (5,10) | 4.22 |
| 26 | 5 walls with 20% porosity | (5,20) | 3.75 |
| 27 | 5 walls with 30% porosity | (5,30) | 3.28 |
| 28 | 5 walls with 40% porosity | (5,40) | 2.81 |
| 29 | 5 walls with 50% porosity | (5,50) | 2.34 |
| 30 | 5 walls with 60% porosity | (5,60) | 1.88 |
| 31 | 6 walls with 10% porosity | (6,10) | 5.06 |
| 32 | 6 walls with 20% porosity | (6,20) | 4.50 |
| 33 | 6 walls with 30% porosity | (6,30) | 3.94 |
| 34 | 6 walls with 40% porosity | (6,40) | 3.38 |
| 35 | 6 walls with 50% porosity | (6,50) | 2.81 |
| 36 | 6 walls with 60% porosity | (6,60) | 2.25 |
| 37 | Rubble mound, Submerged | RMOB-S | 58.93 |
| 38 | Rubble mound, Crest and SWL at the same level | RMOB-C | 78.13 |
| 39 | Rubble mound, Emerged | RMOB-E | 100.0 |
| 40 | 1 wall with 5% porosity | (1,5) | 0.89 |
| 41 | 2 walls with 5% porosity | (2,5) | 1.78 |
| 42 | 3 walls with 5% porosity | (3,5) | 2.67 |
| 43 | 4 walls with 5% porosity | (4,5) | 3.56 |
| 44 | 5 walls with 5% porosity | (5,5) | 4.45 |

TABLE 1-continued

Volume savings for slotted wall barrier

| Configuration Number | Model Description | Symbol (n, P) | (V1/V2) % |
|---|---|---|---|
| 45 | 6 walls with 5% porosity | (6,5) | 5.34 |
| 46 | 1 wall with 0% porosity | (1,0) | 0.94 |

For example, as seen in Table 1 above, a slotted barrier having 1 wall with 10% porosity has 0.84% the volume of an emerged, rubble breakwater. The highest volume percentage compared to the emerged, rubble breakwater is 5.34% for the slotted barrier with six walls having 5% porosity.

Table 2 below provides an example of a table that may be used for selecting a proper slotted barrier based on relative water depth ($d/L_p$), relative significant wave height ($H_{is}/d$), and wave transmission coefficient ($K_t$). $L_p$ is the wavelength that corresponds to the peak period. Table 2 indicates which (n,P) combinations from Table 1 resulted in $0.1<K_T<0.15$ for multiple relative water depths and significant wave heights.

TABLE 2

Slotted Vertical Barriers for $0.1 \leq K_t < 0.15$ at Selected Wave Conditions

| | $H_{is}/d$ | | |
|---|---|---|---|
| $d/L_p$ | 0.071 | 0.143 | 0.214 |
| 0.1 | — | — | (4,5) |
| 0.2 | — | (4,5), (5,5), (6,5), (5,10), (6,10) | (4,5), (5,5), (5,10), (6,10) |
| 0.3 | (5,5), (6,5), (6,10) | (4,5), (4,10), (5,10), | (3,5), (4,5), (4,10), (6,20) |
| 0.4 | (5,5), (5,10), (6,10) | (3,5), (4,5), (4,10), (6,20) | (3,5), (4,5), (3,10), (4,10), (5,20), (6,20) |
| 0.5 | (4,5), (4,10), (5,10) | (3,5), (4,5), (3,10), (4,10), (5,20), (6,20) | (3,5), (4,5), (3,10), (4,10), (5,20), (6,20) |

Table 2 will facilitate a user in selecting the proper slotted vertical barrier if the user knows the relative water depth and relative significant wave height of the location requiring wave damping, as well as a desired $K_t$ value ($0.1<K_t<0.15$). Similar charts can be created (and are available from the inventors) for different relative water depth, relative significant wave height, and $K_t$ values (such as $K_t<0.065$; $0.065<K_t<0.1$; $0.15<K_t<0.2$; $0.2<K_t<0.25$; $0.25<K_t<0.3$; $0.3<K_t<0.35$; $0.35<K_t<0.4$; $0.4<K_t<0.45$; $0.45<K_t<0.5$). In addition, Table 1 can be used to further narrow the results of Table 2 based on the amount of material available, or desired, for the breakwater.

Table 3 provides insight into selecting the best performing or most economic slotted vertical barrier, and how the $K_t$ of best performing and most economic slotted vertical barriers compares to the $K_t$ of an emerged, rubble mound breakwater.

TABLE 3

Wave Transmission Performance of Selected Slotted Vertical Barriers

| S. No. | $H_{is}/d$ | $d/L_p$ | $K_t$ of Reference Emerged RMOB, $K_{tRM}$ | Best SVB | $K_{tb}$ | Economy SVB | $K_{te}$ | No. of SVB better than Emerged RMOB | $[(K_{tRM}-K_{tb})/K_{tRM}] \times 100$ | $[(K_{tRM}-K_{te})/K_{tRM}] \times 100$ |
|---|---|---|---|---|---|---|---|---|---|---|
| 1 | 0.071 | 0.50 | 0.17 | (6,5) | 0.076 | (3,5) | 0.153 | 7 | 55.29 | 10.00 |
| 2 | 0.142 | 0.50 | 0.142 | (6,5) | 0.058 | (3,5) | 0.123 | 8 | 59.15 | 13.38 |
| 3 | 0.214 | 0.50 | 0.139 | (6,5) | 0.058 | (3,5) | 0.119 | 8 | 58.27 | 14.39 |
| 4 | 0.071 | 0.40 | 0.194 | (6,5) | 0.09 | (3,5) | 0.181 | 6 | 53.61 | 6.70 |

TABLE 3-continued

Wave Transmission Performance of Selected Slotted Vertical Barriers

| S. No. | $H_{is}/d$ | $d/L_p$ | $K_t$ of Reference Emerged RMOB, $K_{tRM}$ | Best SVB | $K_{tb}$ | Economy SVB | $K_{te}$ | No. of SVB better than Emerged RMOB | $[(K_{tRM} - K_{tb})/K_{tRM}] \times 100$ | $[(K_{tRM} - K_{te})/K_{tRM}] \times 100$ |
|---|---|---|---|---|---|---|---|---|---|---|
| 5 | 0.142 | 0.40 | 0.153 | (6,5) | 0.063 | (3,5) | 0.133 | 8 | 58.82 | 13.07 |
| 6 | 0.214 | 0.40 | 0.154 | (6,5) | 0.061 | (3,5) | 0.125 | 10 | 60.39 | 18.83 |
| 7 | 0.071 | 0.30 | 0.238 | (6,5) | 0.117 | (3,5) | 0.22 | 7 | 50.84 | 7.56 |
| 8 | 0.142 | 0.30 | 0.181 | (6,5) | 0.08 | (3,5) | 0.157 | 8 | 55.80 | 13.26 |
| 9 | 0.214 | 0.30 | 0.183 | (6,5) | 0.072 | (3,10) | 0.168 | 10 | 60.66 | 8.20 |
| 10 | 0.071 | 0.20 | 0.294 | (6,5) | 0.161 | (3,5) | 0.27 | 8 | 45.24 | 8.16 |
| 11 | 0.142 | 0.20 | 0.233 | (6,5) | 0.113 | (3,5) | 0.204 | 9 | 51.50 | 12.45 |
| 12 | 0.214 | 0.20 | 0.240 | (6,5) | 0.1 | (2,5) | 0.219 | 13 | 58.33 | 8.75 |
| 13 | 0.071 | 0.10 | 0.416 | (4,5) | 0.207 | (3,5) | 0.4 | 8 | 50.24 | 3.85 |
| 14 | 0.142 | 0.10 | 0.347 | (6,5) | 0.222 | (3,5) | 0.332 | 9 | 36.02 | 4.32 |
| 15 | 0.214 | 0.10 | 0.355 | (4,5) | 0.142 | (2,5) | 0.32 | 13 | 60.00 | 9.86 |

The second and third columns indicated relative significant wave height ($H_{is}/d$) and relative water depth ($d/L_p$) in the ranges of 0.071-0.214 and 0.1-0.5, respectively. The fourth column indicates $K_{tRM}$, which is the $K_t$ of an emerged offshore rubble mound breakwater structure. The fifth and sixth columns indicate which slotted vertical barriers perform the best based on lowest $K_t$, and the respective $K_t$, which is listed as $K_{tb}$. The seventh and eight columns indicate which slotted vertical barriers are the most economical and the respective $K_t$, which is listed as $K_{te}$. Most economical is determined by selecting the slotted vertical barrier that has a lower $K_t$ than $K_{tRM}$ with the lowest volume based on the ($V_1/V_2$) values in Table 1. The ninth column indicates the number of slotted barrier configurations better than an emerged offshore rubble mound breakwater available among the forty-two slotted vertical barriers tested, as listed in Table 1 (except three different rubble mound breakwater arrangements and one vertical wall structure with 0% porosity). The tenth column indicates the percentage of improvement over $K_{tRM}$ for the best performing slotted vertical barrier, and the eleventh column indicates the percentage of improvement over $K_{tRM}$ for the most economical barrier. As seen above, even the most economical barrier has a significant improvement over the rubble mound breakwater.

Figure 4:
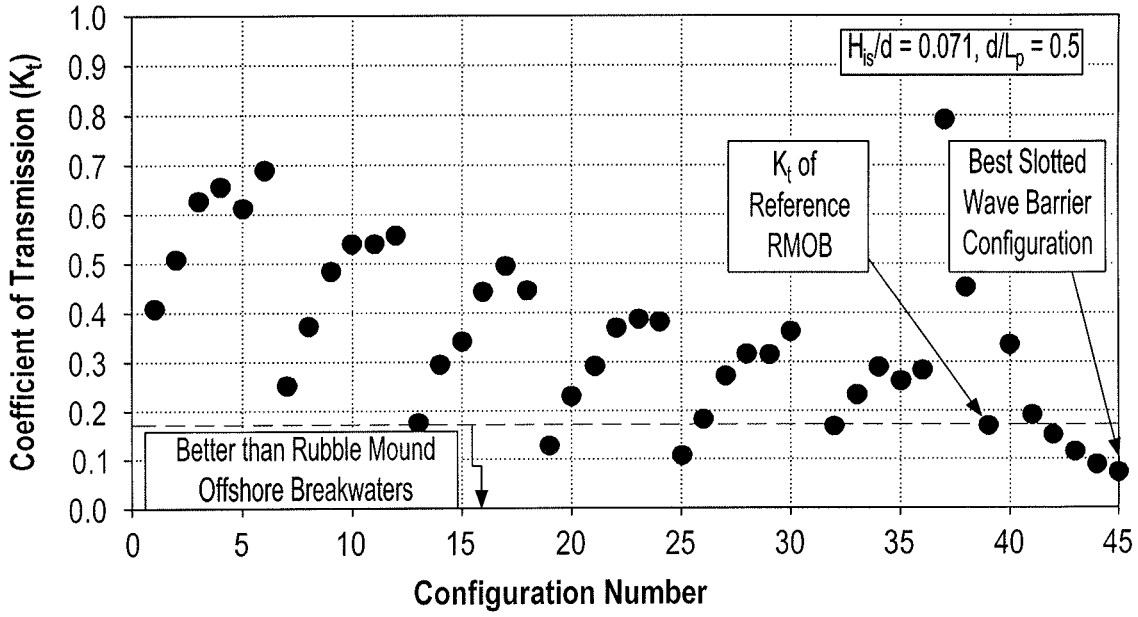
FIG. 4 is a plot of the wave transmission coefficient ($K_t$) values of each slotted vertical barrier listed in Table 1 for a typical relative significant wave height ($H_{is}/d$) of 0.071 m and a relative water depth ($d/L_p$) of 0.5 m, compared to the coefficient of a reference rubble mound offshore breakwater, where $H_{is}$ is the incident significant wave height, d is the water depth, and $L_p$ is the wavelength corresponding to peak wave period.

FIG. 4 is a graph showing the $K_t$ values of each slotted vertical barrier listed in Table 1 for a relative significant wave height of 0.071 m and a relative water depth of 0.5 m. The y-axis of the graph indicates $K_t$ and the x-axis indicates the configuration number from Table 1. The dotted line indicates the threshold for which slotted vertical barriers perform better than the emerged rubble mound breakwater. The slotted vertical barriers below the line perform better than the emerged rubble mound offshore breakwater. As seen in FIG. 4, configurations 19, 25, 31, 32, 42, 43, 44, and 45 perform better than the emerged rubble mound offshore breakwater. The volume of the better performing slotted vertical barriers are 3.38%, 4.22%, 5.06%, 4.5%, 2.67%, 3.56%, 4.45%, and 5.34%, respectively, of the emerged rubble mound offshore barrier. Similar graphs may be created for different combinations of relative significant wave height and relative water depth.

Figure 5:
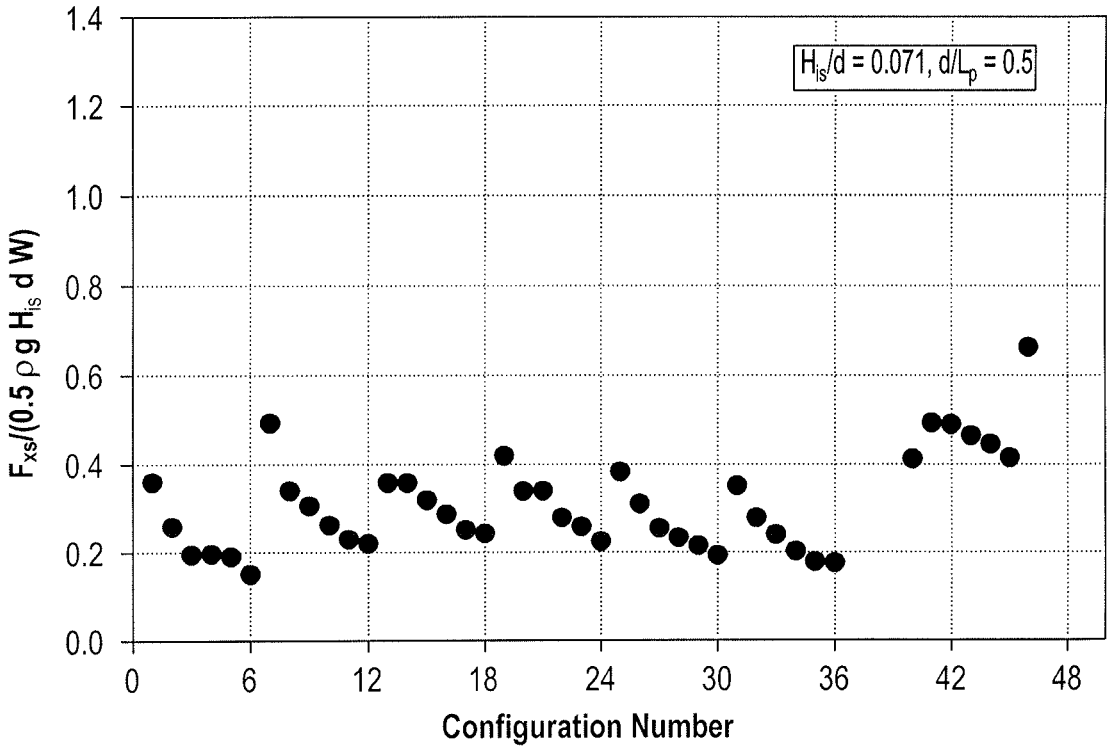
FIG. 5 is a plot of the normalized horizontal force exerted against the different barrier configurations due to waves for a relative significant wave height of 0.071 m and a relative water depth of 0.5 m.

FIG. 5 shows the normalized horizontal force $F_n$ exerted on the different barrier configurations due to waves for the relative significant wave height ($H_{is}/d$) and the relative water depth ($d/L_p$) used in FIG. 3, 0.071 and 0.5, respectively. Normalized horizontal force $F_n$ is calculated by the following equation:

$$F_n = F_{XS}/0.5*\rho*g*H_{is}*d*W$$

where $F_{XS}$ is the significant horizontal wave force in newtons, ρ is the mass density of water (1000 kg/m$^3$), g is the acceleration due to gravity (9.81 m/s$^2$), $H_{is}$ is the significant incident wave height in meters, and W is the width of the barrier in meters. The x-axis indicates the configuration number front Table 1. As seen in the drawing, the normalized wave force exerted on the slotted vertical barriers decreases with an increase in porosity. Therefore, a desired transmission coefficient $K_t$ and normalized wave force $F_n$ can be achieved by increasing the porosity to decrease the normalized wave force $F_n$ and increasing the number of walls 22 to maintain the desired transmission coefficient $K_t$. Accordingly, normalized horizontal force $F_n$ may be used for the design of the slotted vertical barrier against horizontal sliding.

Figure 6:
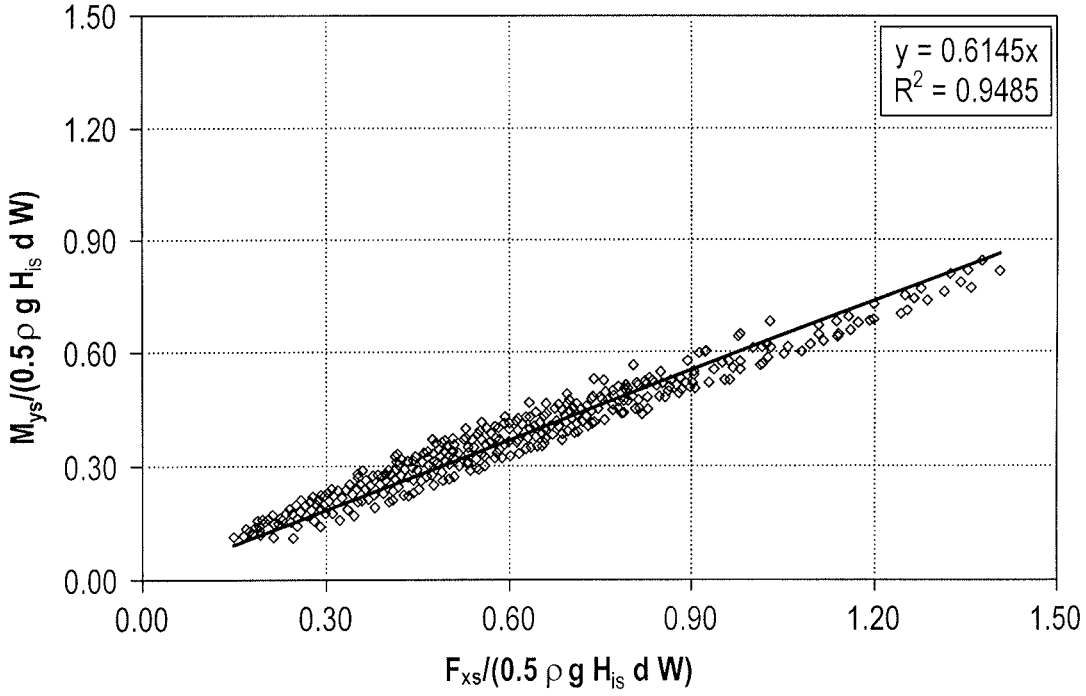
FIG. 6 is a plot of the correlation between normalized wave-induced moment and normalized horizontal wave force applied to the different barrier configurations due to waves for a relative significant wave height of 0.071 m and a relative water depth of 0.5 m.

FIG. 6 shows the normalized wave-induced moment $M_n$ exerted on the different barrier configurations due to waves for the relative significant wave height ($H_{is}/d$) and the relative water depth ($d/L_p$) used in FIG. 3, 0.071 and 0.5, respectively, versus the normalized horizontal force $F_n$. The normalized wave-induced moment $M_n$ is calculated using the following equation:

$$M_n = M_{ys}/0.5*p*g*H_{is}*d*W,$$

where $M_{ys}$ can be estimated using the following equation:

$$M_{ys}, = 0.6145*d*F_{XS}$$

and the remaining variables are the same as discussed above. The wave-induced moment is equal to the product of the total horizontal wave force and the lever arm from the base. The estimation of the significant moment $M_{ys}$ based on the horizontal wave force $F_{XS}$ is good with a correlation coefficient $R^2$ of 0.9485. The wave induced moment can be used to check the stability of the slotted wave barrier structure against overturning.

It is necessary to consider the wave-induced moment exerted on the barrier when determining if the waves will cause the barrier to overturn. Since the normalized wave induced moment $M_n$ is directly correlated to the normalized horizontal force $F_n$, an increase in porosity results in a decrease in wave induced moment $M_n$. Therefore, a desired transmission coefficient $K_t$ and wave induced moment $M_n$ can be achieved by increasing the porosity to decrease the wave induced moment $M_n$ and increasing the number of walls 22 to maintain the desired transmission coefficient $K_t$. Additionally, the size and weight of the horizontal support plate 28 at the bottom of the barrier 20*a* or 20*b* may be altered to provide additional stability against sliding and overturning.

Figure 7:
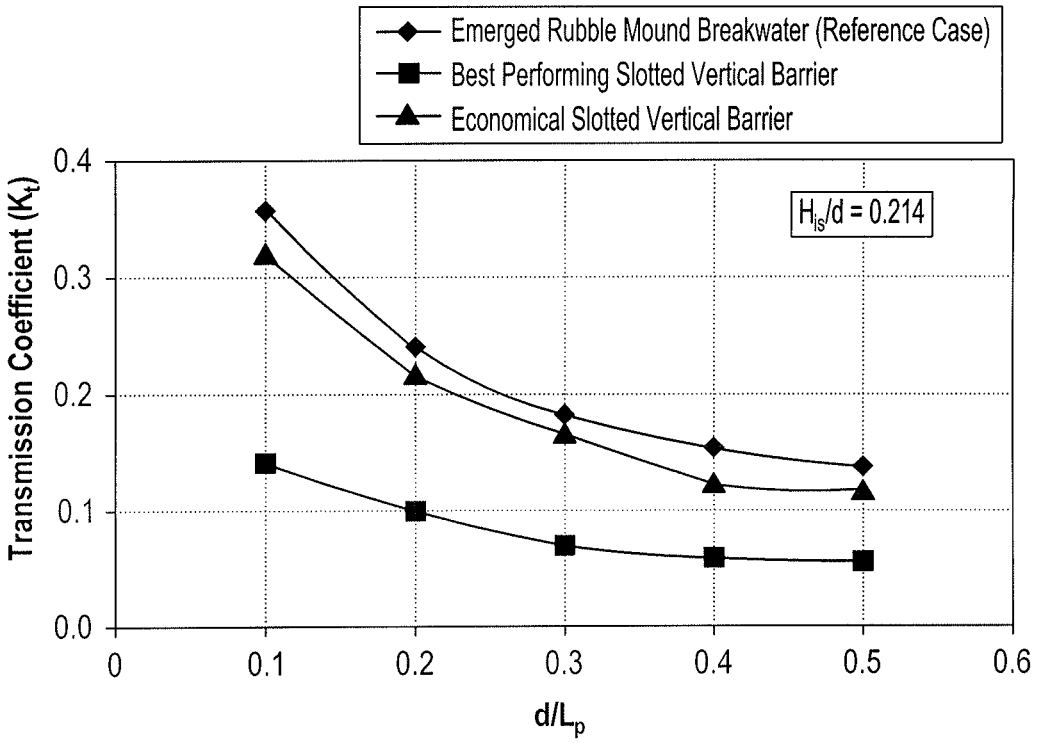
FIG. 7 is a plot of transmission coefficient versus relative water depth for the best performing slotted vertical barriers from Table 3, the most economical vertical barriers from Table 3, and the reference emerged, rubble mound breakwater for relative significant wave height of 0.214 m.

FIG. 7 shows transmission coefficient $K_t$ versus relative water depth ($d/L_p$) for the best performing slotted vertical barriers of Table 3, the most economical vertical barriers of Table 3, and the emerged rubble mound breakwater for a relative significant wave height ($H_{is}/d$) of 0.214 m. As seen in the figure both the best performing and most economical barriers perform significantly better than the emerged rubble mound breakwater with regard to transmission coefficient $K_t$ through a range of relative water depths.

It is to be understood that the present method for damping ocean waves in a coastal area is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A method for damping ocean waves in a coastal area, comprising the steps of:

providing a horizontal support surface on the seabed in the coastal area;

determining a desired transmission coefficient equal to a ratio between wave height of the ocean waves transmitted between a slotted vertical barrier and the coast to be protected and wave height of the ocean waves incident on the slotted vertical barrier;

collecting experimental data correlating transmission coefficients with a number of parallel vertical walls in the slotted vertical barrier and a porosity of the parallel vertical walls in the slotted vertical barrier for a plurality of ratios of significant wave height to depth of still water in the coastal area and for a plurality of ratios of the depth of still water in the coastal area to wavelength of the ocean waves at peak period;

selecting from the collected experimental data a combination of the number of parallel vertical walls and porosity of the parallel vertical walls to produce the desired transmission coefficient given the ratio of significant wave height to depth of still water in the coastal area and the ratio of the depth of still water in the coastal area to the wavelength of the ocean waves at peak period; and constructing a wave barrier for damping ocean waves, the wave barrier including erecting a slotted vertical barrier extending upwardly from the horizontal support surface on the seabed, the vertical barrier having the selected number of parallel vertical walls and the selected porosity of the vertical walls between the ocean waves and the coast to be protected in order to dampen the ocean waves in the coastal area, wherein the parallel vertical walls each have a plurality of alternating slats and slots extending horizontally across the vertical wall.

2. The method for damping ocean waves according to claim 1, wherein the porosity of each of the parallel vertical walls is expressed as a percentage of an area defined by the slots in the vertical wall to a total area of the vertical wall.

3. The method for damping ocean waves according to claim 1, wherein the step of selecting a combination of the number of parallel vertical walls and porosity of the parallel vertical walls comprises selecting the combination producing the minimum transmission coefficient.

4. The method for damping ocean waves according to claim 1, wherein said step of collecting experimental data further comprises collecting experimental data correlating transmission coefficients of an emerged rubble mound breakwater for a plurality of ratios of significant wave height to depth of still water in the coastal area and for a plurality of ratios of the depth of still water in the coastal area to wavelength of the ocean waves at peak period.

5. The method for damping ocean waves according to claim 4, wherein the step of selecting a combination of the number of parallel vertical walls and porosity of the parallel vertical walls comprises selecting a combination producing a transmission coefficient less than the transmission coefficient of the emerged rubble mound breakwater for the plurality of ratios of significant wave height to depth of still water in the coastal area and for the plurality of ratios of the depth of still water in the coastal area to wavelength of the ocean waves at peak period.

6. The method for damping ocean waves according to claim 4, further comprising the step of calculating a ratio of a volume of material required to erect a slotted vertical barrier having a number of walls and porosity to produce the collected transmission coefficient a volume of material required to erect the emerged rubble mound breakwater for the ratio of significant wave height to depth of still water in the coastal area and the ratio of the depth of still water in the coastal area to the wavelength of the ocean waves at peak period.

7. The method for damping ocean waves according to claim 6, wherein the step of selecting a combination of the number of parallel vertical walls and porosity of the parallel vertical walls comprises selecting a combination producing a transmission coefficient less than the transmission coefficient of the emerged rubble mound breakwater for the plurality of ratios of significant wave height to depth of still water in the coastal area and for the plurality of ratios of the depth of still water in the coastal area to wavelength of the ocean waves at peak period and having the lowest ratio of material required to erect the slotted vertical barrier to material required to erect the emerged rubble mound breakwater.

8. The method for damping ocean waves according to claim 1, wherein the step of constructing the wave barrier further includes the step of determining the walls have a porosity of between 5% and 60%.

9. The method for damping ocean waves according to claim 8, wherein the step of constructing the wave barrier further includes the step of determining the barrier defines a transmission coefficient equal to wave height of waves transmitted between the wave barrier and the coastal area to be protected divided by wave height of ocean waves incident on the wave barrier, the transmission coefficient being correlated with both number of walls in the barrier and the porosity of the walls.

* * * * *